US009669450B2

(12) United States Patent
Nakai

(10) Patent No.: US 9,669,450 B2
(45) Date of Patent: Jun. 6, 2017

(54) PUNCH TOOL DEVICE AND METHOD OF SUPPLYING LUBRICATING OIL

(75) Inventor: Hiroshi Nakai, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 991 days.

(21) Appl. No.: 13/264,028

(22) PCT Filed: Apr. 12, 2010

(86) PCT No.: PCT/JP2010/056527

§ 371 (c)(1),
(2), (4) Date: Oct. 12, 2011

(87) PCT Pub. No.: WO2010/119839

PCT Pub. Date: Oct. 21, 2010

(65) Prior Publication Data

US 2012/0031245 A1 Feb. 9, 2012

(30) Foreign Application Priority Data

Apr. 15, 2009 (JP) ..... 2009-099247
Jan. 7, 2010 (JP) ..... 2010-002004

(51) Int. Cl.
*B21D 28/02* (2006.01)
*B21D 37/18* (2006.01)
*B21D 28/34* (2006.01)

(52) U.S. Cl.
CPC ..... *B21D 28/34* (2013.01); *B21D 37/18* (2013.01); *Y10T 83/04* (2015.04); *Y10T 83/263* (2015.04); *Y10T 83/9423* (2015.04)

(58) Field of Classification Search
CPC ..... B21D 28/12; B21D 28/34; B21D 45/006; B21D 28/125; B21D 45/003; B21D 37/18;
(Continued)

(56) References Cited

U.S. PATENT DOCUMENTS

2008/0092713 A1* 4/2008 Takahashi et al. ..... 83/698.91

FOREIGN PATENT DOCUMENTS

GB 1311681 * 3/1973 ..... B21D 28/24
GB 2104822 * 3/1983 ..... B21D 28/00
(Continued)

*Primary Examiner* — Laura M Lee
(74) *Attorney, Agent, or Firm* — Greenblum & Bernstein, P.L.C.

(57) ABSTRACT

A punch tool device vertically that is movably mounted in a punch mounting hole formed in a punch holder of a punch press includes: a punch body vertically movably provided inside a tubular punch guide vertically movably mounted in a punch mounting hole and, the punch body includes a punch edge section in its lower end portion. An elastic member is provided between the punch guide and a punch head provided on an upper end portion of a punch driver provided above the punch body. A supported section is supported by a lifter spring provided to the punch holder, is provided on an outer peripheral surface of the punch guide; and a lubricating oil path is provided in the outer peripheral surface of the punch guide so as to communicate with a lubricating oil supply path formed in the punch body, the lubricating oil path provided to be capable of coming into and out of communication with a lifter spring containing hole which contains the lifter spring.

17 Claims, 6 Drawing Sheets

(58) Field of Classification Search
CPC ..... Y10T 83/8732; Y10T 83/263; Y10T 83/8785; Y10T 83/9423; Y10T 83/9476; Y10T 83/8759
USPC ..... 83/22, 169–171, 552, 588, 687, 691
See application file for complete search history.

(56) References Cited

FOREIGN PATENT DOCUMENTS

| | | |
|---|---|---|
| JP | 61-172632 | 8/1986 |
| JP | 3-24320 | 3/1991 |
| JP | 4-44260 | 10/1992 |
| JP | 3051596 | 6/1998 |
| JP | 2002-153922 | 5/2002 |
| WO | 2006/054694 | 5/2006 |

* cited by examiner

PUNCH TOOL DEVICE AND METHOD OF SUPPLYING LUBRICATING OIL

TECHNICAL FIELD

The present invention relates to: a punch tool device used while mounted on a punch press such as a turret punch press, for example; and a method of supplying lubricating oil. More specifically, the present invention relates to: a punch tool device having a function of lubricating the interface between the inner peripheral surface of a punch mounting hole provided in a punch press and the outer peripheral surface of a punch guide of the punch tool device while receiving a supply of oil mist from a striker vertically movably provided to the punch press; and a method of supplying lubricating oil.

BACKGROUND ART

A general structure of the punch tool device is as follows. For example, a punch body integrally having a punch edge section in its lower end portion is installed in a tubular punch guide vertically movably supported by an upper turret of a turret punch press. In addition, a stripper spring is resiliently installed between the punch guide and a punch head provided on an upper end portion of a punch driver which is integrally provided to the punch body in a manner projecting upward from the punch guide.

Some striker, which is vertically movably provided to the punch press in order to strikingly press the punch head of the punch tool device, is configured to have a function of supplying a jet of oil mist to the inside of the punch tool device via a through-hole provided in the punch head. In conjunction with this, some punch tool device is configured to receive a supply of the oil mist to lubricate the interface between the inner peripheral surface of the punch guide and the outer peripheral surface of the punch body, and the interface between the inner peripheral surface of the punch mounting hole of the punch press and the outer peripheral surface of the punch guide (see Patent Documents 1 and 2, for example).

Incidentally, the structure to vertically movably support the punch tool device inside the punch mounting hole of the punch press is a supporting structure using multiple lifter springs provided in their respective locations around the punch mounting hole (see Patent Document 3).

PRIOR ART DOCUMENTS

Patent Documents

Patent Document 1: Japanese Utility Model Application Laid-Open No. Hei 3-24320

Patent Document 2: Japanese Examined Utility Model Application Publication No. Hei 4-44260

Patent Document 3: Japanese Patent Application Laid-Open No.

DISCLOSURE OF THE INVENTION

Technical Problem

As disclosed in Patent Document 3, each lifter spring for vertically movably supporting the punch tool device has a structure as follows. The lifter spring has a guide member, such as a stripper bolt, which is set up around the punch mounting hole in the upper turret. A lifter ring for supporting a pin or a flange which is projectingly provided on the outer peripheral surface of the punch guide of the punch tool device is vertically movably provided to the guide member. An elastic member, such as a coil spring, for biasing the lifter ring upward is provided under the lifter ring.

On the other hand, the punch tool device, which receives a supply of oil mist and lubricates the interface between the internal peripheral surface of the punch mounting hole and the outer peripheral surface of the punch guide, has a structure in which a peripheral groove for supplying lubricating oil is provided in the outer peripheral surface of the punch guide. In other words, no lubricating oil (oil mist) is supplied to the lifter springs conventionally.

For this reason, vertical movements of the lifter rings are likely to become less smooth as a punching process on plate-shaped workpieces continues for a longer time. This presents a problem that the following operation of the punch tool device sometimes falls behind the vertical movements of the striker in the high-speed punching process on workpieces.

The present invention has been made to solve the foregoing problem. Accordingly, an object of the present invention is to provide: a punch tool device capable of supplying oil mist to the insides of lifter spring containing holes which contain the respective lifter springs; and a method of supplying lubricating oil.

Technical Solution

To achieve the above-described object, a first aspect of the present invention is a punch tool device vertically movably mounted in a punch mounting hole formed in a punch holder of a punch press, comprising: a tubular punch guide vertically movably mounted in a punch mounting hole; a punch body vertically movably provided inside the punch guide, and including a punch edge section in its lower end portion; a punch driver provided above the punch body; a punch head provided on an upper end portion of the punch, driver; an elastic member provided between the punch head and the punch guide; and a supported section supported by a lifter spring provided to the punch holder, the supported section provided on an outer peripheral surface of the punch guide, wherein a lubricating oil path communicating with a lubricating oil supply path formed in the punch body is provided in the outer peripheral surface of the punch guide, and the lubricating oil path is provided in a way capable of coming into and out of communication with a lifter spring containing hole which contains the lifter spring.

A second aspect of the present invention is the punch tool device according to the first aspect, wherein the lubricating oil path is provided at a position higher than a vertically-directed key groove that is formed in the punch guide and engages with a key provided to any one of the punch body and the punch driver.

A third aspect of the present invention is A punch tool device vertically movably mounted in a punch mounting hole formed in a punch holder of a punch press, comprising: a tubular punch guide vertically movably mounted in a punch mounting hole; a punch body vertically movably provided inside the punch guide, and including a punch edge section in its lower end portion; a punch driver provided above the punch body; a punch head provided on an upper end portion of the punch driver; an elastic member provided between the punch head and the punch guide; and a supported section supported by a lifter spring provided to the punch holder, the supported section provided on an outer peripheral surface of the punch guide, wherein a lubricating oil hole formed in the punch body horizontally in a radial direction is provided in such a way to open to an outer peripheral surface of the punch body, and an upper portion of the punch guide is provided with an emission hole for emitting lubricating oil, which pools on an upper surface of the punch body, to the lifter spring.

A fourth aspect of the present invention is the punch tool device according to the third aspect, wherein a communication hole alignable with the lubricating oil hole in a straight line is provided to the punch guide in a range where the lubricating oil emitted from the emission hole flows down.

A fifth aspect of the present invention is the punch tool device according to the fourth aspect, wherein the emission hole always opens to the lifter spring regardless of vertical movements of the punch guide.

A sixth aspect of the present invention is a method of supplying lubricating oil to a lifter spring by use of a punch tool device, the punch tool device including: a tubular punch guide vertically movably mounted in a punch mounting hole formed in a punch holder of a punch press; a punch body vertically movably provided inside the punch guide, and including a punch edge section in its lower end portion; a punch driver provided above the punch body; a punch head provided on an upper end portion of the punch driver; an elastic member provided between the punch head and the punch guide; a supported section supported by a lifter spring provided to the punch holder, the supported section provided on an outer peripheral surface of the punch, guide; a lubricating oil hole formed in the punch body horizontally in a radial direction, and provided in such a way as to open to an outer peripheral surface of the punch body; an emission hole for emitting lubricating oil, which pools on an upper surface of the punch body, to the lifter spring, the emission hole provided in an upper portion of the punch guide in such a way as to always open to the lifter spring regardless of vertical movements of the punch guide; and a communication hole alignable with the lubricating hole in a straight line, and provided in the punch guide in a range where the lubricating oil emitted from the emission hole flows down, the method comprising the steps of: bringing a striker of the punch press into contact with the punch head of the punch tool device; holding the lubricating oil hole and the communication hole in a state of being aligned with each other in a straight line; and directly supplying the lubricating oil to the lifter spring from the lubricating oil hole via the communication hole.

Advantageous Effects

According to the present invention, the lubricating oil path, which is provided in the outer peripheral surface of the punch guide of the punch tool device, can come into and out of communication with the lifter spring containing hole which contains the lifter spring. For this reason, while the lubricating oil path is in communication with the lifter spring containing hole, the oil mist is supplied to the inside of the lifter sprint containing hole, and thereby the lifter spring can be lubricated. While the lubricating oil path is out of communication with the lifter spring containing hole, the pressure of the lubricating oil path of the punch tool device is prevented from leaking out to the lifter spring containing hole, and thereby the oil mist can be spread throughout every part in the punch tool device.

BEST MODES FOR CARRYING OUT THE INVENTION

Figure 1:
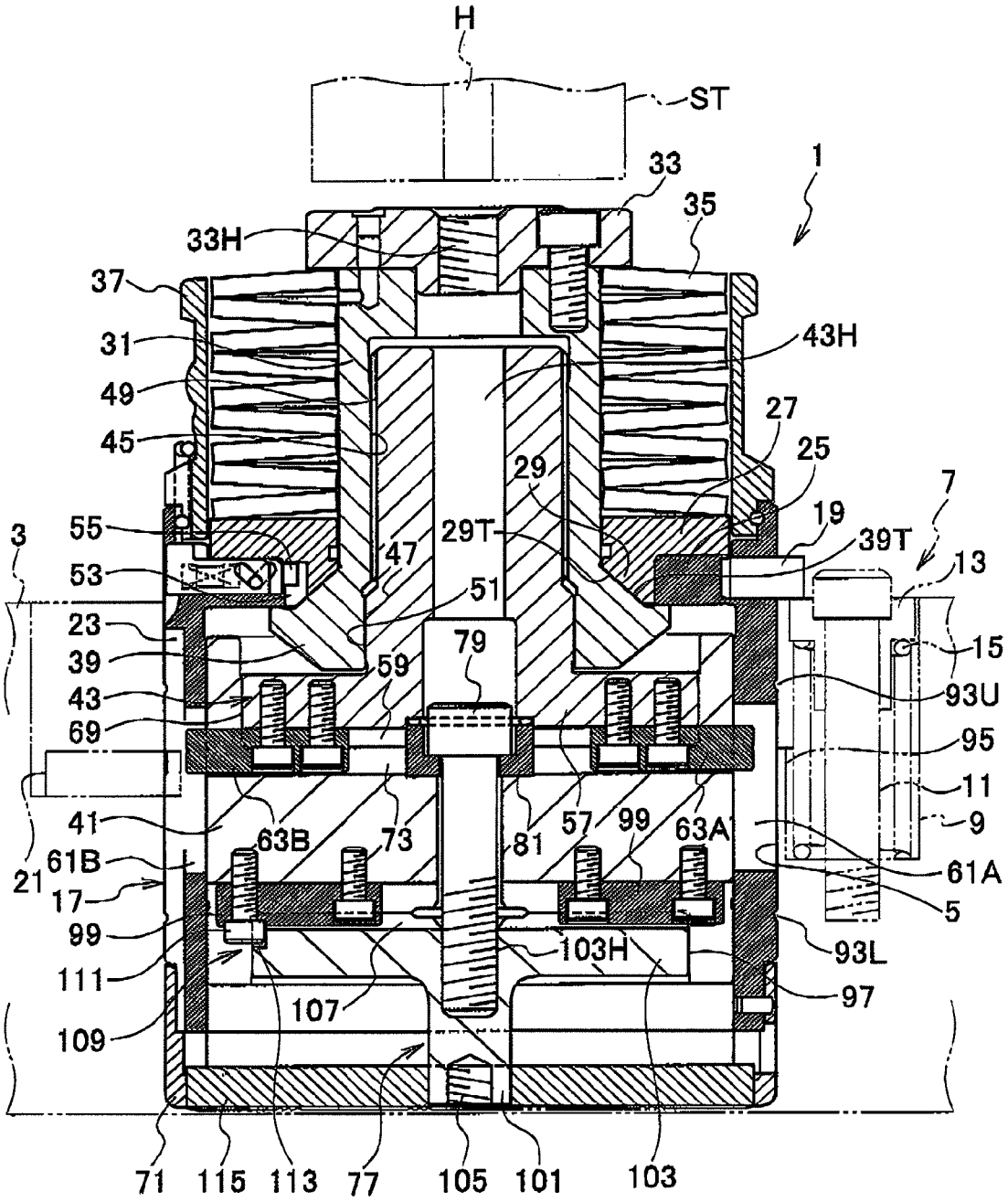
FIG. 1 is a front cross-sectional explanatory view of a punch tool device of an embodiment of the present invention.

As shown in FIG. 1, a punch tool device 1 of an embodiment of the present invention is used while mounted on a punch holder 3, such as an upper turret, in the punch press (illustration is omitted), for example, a turret punch press. In the punch holder 3, lifter springs 7 configured to vertically movably support the punch tool device 1 are respectively provided in multiple locations around a punch mounting hole 5 in which the punch tool device 1 is fittingly mounted vertically movably. To put it specifically, lifter spring containing holes 9 are respectively provided in multiple locations around the punch mounting hole 5 in the punch holder 3. Bolts (guide members) 11 are set up in the lifter spring containing holes 9, respectively. Elastic members 15, such as coil springs, are resiliently installed between lifter rings 13 vertically movably fitted to the bolts 11 and bottom portions of the lifter spring containing holes 9, respectively. More detailed descriptions will be omitted for the function and working of the lifter springs 7, because the lifter springs 7 are of a well-known structure.

The punch tool device 1 includes a tubular punch guide 17 which is vertically movably mounted in the punch mounting hole 5, and has supported sections 19, such as pins, in the respective multiple locations on the outer peripheral surface of the punch guide 17. The supported sections 19 are supported by the lifter rings 13 of the lifter springs 7, respectively. The supported sections 19 may have flange structures. In addition, a vertically-directed key groove 23, which engages with a guide key 21 provided to the punch holder 3, is formed in the outer peripheral surface of the punch guide 17.

An inner flange 25 projecting inward is provided to an upper portion of the punch guide 17. A retainer collar 27 rotatably provided on top of the inner flange 25 includes a downward-projecting portion 29 whose outer peripheral surface is in slide contact with the inner peripheral surface of the inner flange 25 so as to make the axis of the punch guide 17 coincide with the axis of the retainer collar 27. In addition, a strong stripper spring (elastic member) 35, such for example as a disc spring, is resiliently installed between the retainer collar 27 and a punch head 33 integrally fixed to an upper portion of a tubular punch driver 31 which vertically movably penetrates through an axial portion of the retainer collar 27. Furthermore, a tubular cover 37 enclosing the stripper string 35 is attached to the upper portion of the punch guide 17.

A flange portion 39, whose upper surface around the outer peripheral edge is in contact with the undersurface of the inner flange 25 of the punch guide 17, is provided in the lower portion of the punch driver 31. The flange portion 39 and the retainer collar 27 are equipped with an automatic self-aligning function portion for automatically aligning the axes thereof with each other. In other words, a taper hole 29T whose diameter becomes larger downward is formed in the downward-projecting portion 29 of the retainer collar 27, while a taper portion 39T, which is engageable with and detachable from the taper hole 29T is formed on the upper surface of the flange portion 39 of the punch driver 31. For this reason, the automatic self-alignment is achieved by the engagement of the taper hole 29T of the retainer collar 27 with the taper portion 39T of the punch driver 31.

When, as described, the automatic self-alignment is achieved by the engagement of the taper hole 29T and the taper portion 39T, the alignment is highly precise with no clearance left between the taper hole 29T and the taper portion 39T.

An adjustment screw member 43 is vertically adjustably screwed in the punch driver 31, and is integrated or integrally provided to an upper portion of the punch body 41 vertically movably provided inside the punch guide 17. In other words, a female screw portion 45 is formed in the inner peripheral surface of the punch driver 31, while a high-precision fitting hole portion 47 is formed under the female screw portion 45 by processing the inner diameter (inner peripheral surface) of the punch driver 31 with high precision. In addition, in the adjustment screw member 43, a male screw portion 49 vertically adjustably screwed in the female screw portion 45 is provided to extend long upward. A high-precision inserted portion 51 is formed in an lower portion of the male screw portion 49 with the outer diameter (outer peripheral surface) thereof processed with high precision corresponding to the high-precision fitting hole portion 47.

For this reason, even if there exists backlash in a screw portion between the female screw portion 45 of the punch driver 31 and the male screw portion 49, the axis of the punch driver 31 and the axis of the adjustment screw member 43 accurately coincide with each other because the clearance between the high-precision fitting hole portion 47 and the high-precision fittingly inserted portion 51 is in the order of microns when the high-precision fittingly inserted portion 51 is screwed in the high-precision fitting hole portion 47. In addition, even in a case where component force directed sideward (in the radial direction) acts on the adjustment screw member 43, the fitting of the high-precision fittingly inserted portion 51 in the high-precision fitting hole portion 47 always keeps the axis of the punch driver 31 and the axis of the adjustment screw member 43 in the state of coinciding with each other.

As already understood, the axis of the punch guide 17 and the axis of the retainer collar 27 are kept in the state of coinciding with each other by fitting the precisely processed outer peripheral surface of the downward-projecting portion 29 of the retainer collar 27 in the precisely processed inner peripheral surface of the inner flange 25 of the punch guide 17, while the axis of the retainer collar 27 and the axis of the punch driver 31 are kept in the state of coinciding with each other by making the taper portion 39T of the punch driver 31 engage with the taper hole 29T formed in the downward-projecting portion 29 of the retainer collar 27. Furthermore, the axis of the punch driver 31 and the axis of the adjustment screw member 43 are kept in the state of coinciding each other by fitting the high-precision fittingly inserted portion 51 of the adjustment screw member 43 in the highly-precision fitting hole portion 47 of the punch driver 31. These collectively realize the high-precision punch tool device in which the axes of the above-mentioned components coincide with one another.

It should be noted that the vertical adjustment of the adjustment screw member 43 is achieved by rotating the punch driver 31 toward or away from the adjustment screw member 43. In this respect, the punch driver 31 and the retainer collar 27 integrally rotate because the biasing force of the strong stripper spring 35 acts on the punch driver 31. For this reason, recess portions 53 are formed in the outer peripheral surface of the downward-projecting portion 29 of the retainer collar 27 at appropriate intervals in the circumferential direction for the purpose of restricting the rotation of the punch driver 31 while the punch driver 31 is put in a normal condition. Furthermore, stoppers 55, which are engageable with and detachable from the respective recess portions 53, are provided to the punch guide 17 in such a way that the stoppers 55 is movable in the radius direction (radial direction) and biased inwardly. Incidentally, detailed descriptions for the stoppers 55 and the like will be omitted, because the structure of the stoppers 55 and the like are publicly known.

Figure 2:
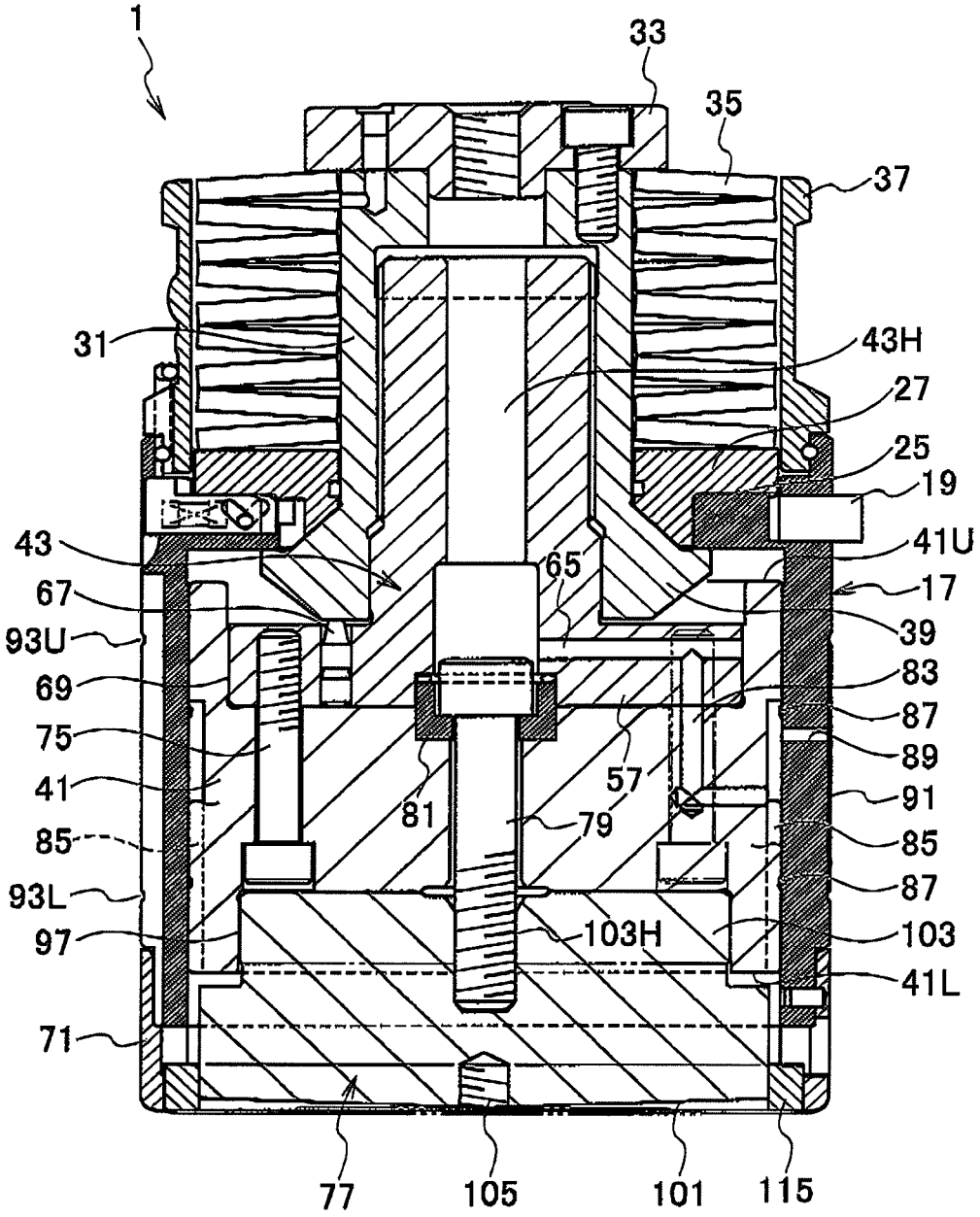
FIG. 2 is a cross-sectional explanatory view showing an organization of a lubricating oil supply path in the punch tool device of the embodiment of the present invention.
Figure 3:
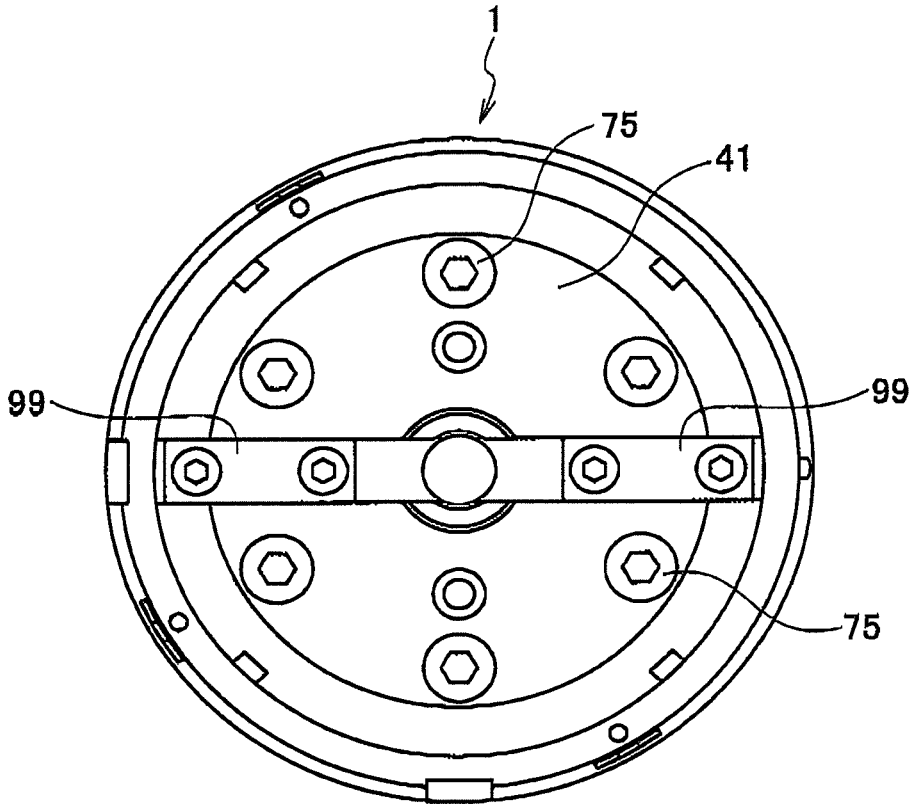
FIG. 3 is a cross-sectional explanatory view showing how keys are attached to a punch body.
Figure 4:
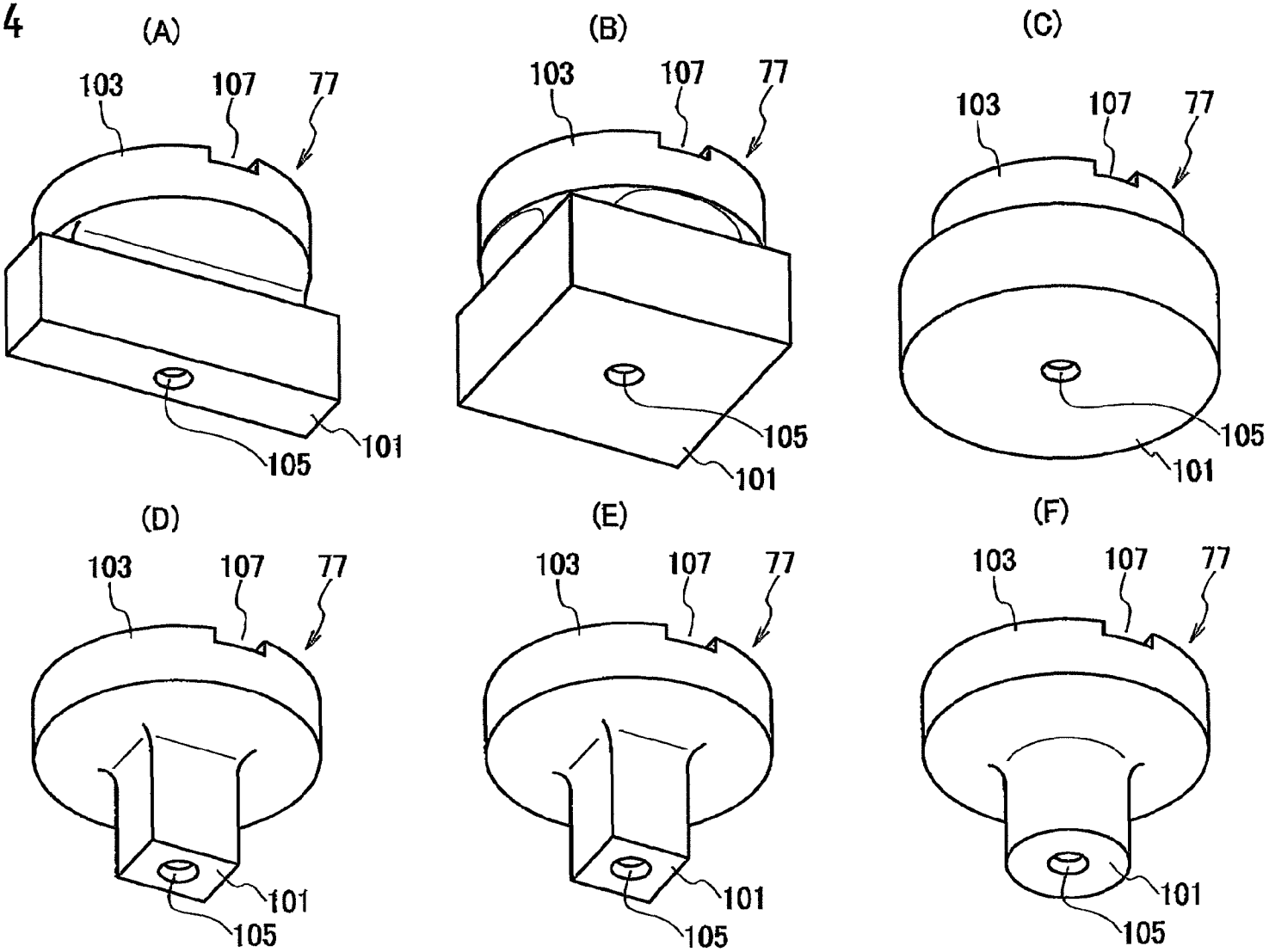
FIG. 4(A) to FIG. 4(F) are perspective explanatory views showing punch tips having their respective various shapes.

A circular fittingly-inserted engagement portion 57, whose outer diameter is larger than that of the punch driver 31, is provided to a lower portion of the adjustment screw member 43. Keys 63A, 63B, which slidably engage with vertically-directed key grooves 61A, 61B formed in the punch guide 17, are integrally attached to the two ends of a radially-directed key groove 59, which is formed in the undersurface of the fittingly-inserted engagement portion 57, by use of fixing parts like bolts, respectively. In addition, as a lubricating oil path, a lubricating oil hole 65 (see FIG. 2), which communicates with a vertically-directed through-hole 430 formed in an axial portion of the adjustment screw member 43, is horizontally formed in the radial direction in the fittingly-inserted engagement portion 57. Moreover, an elastic member 67, such as rubber, for preventing the intimate contact between the fittingly-inserted engagement portion 57 and the undersurface of the punch driver 31 is provided to the fittingly-inserted engagement portion 57 in such a way that the elastic member 67 projects upward.

The punch body 41, which is vertically movably fittingly inserted in the punch guide 17, is formed vertically long for the purpose of inhibiting a galling phenomenon from occurring due to the inclination of the punch body 41 relative to the punch guide 17 in a minute clearance (a clearance in the order of microns) between the inner peripheral surface of the punch guide 17 and the outer peripheral surface of the punch body 41. To put it specifically, an engagement recess portion 69, which the fittingly-inserted engagement portion 57 of the adjust screw member 43 is fittingly inserted and engages with, is formed in the upper surface of the punch body 41. In other words, an upper end surface 41U of the punch body 41 is formed at such a height position that the punch body 41 surrounds the flange portion 39 of the punch driver 31. In addition, a lower end surface 41L of the punch body 41 is provided at almost the same height position as a plate retention holder 71 which is detachably changeably attached to the lower portion of the punch guide 17 while the punch body 41 is put in a state of being raised with respect to the punch guide 17.

Accordingly, it is possible to inhibit the minute inclination of the punch body 41 relative to the punch guide 17 which occurs due to the minute clearance between the punch guide 17 and the punch body 41. Accordingly, it is possible to inhibit the occurrence of the galling phenomenon.

It should be noted that the punch body 41 is integrally attached to the lower portion of the adjustment screw member 43 by use of multiple fixing parts 75 (see FIG. 2), such as attachment bolts, with the fittingly-inserted engagement portion 57 of the adjustment screw member 43 being fittingly inserted in and engaging with the engagement recess portion 69 of the punch body 41, and with the keys 63A, 63B engaging with a radially-directed key groove 73 formed in the punch body 41. Moreover, a ring-shaped washer 81 for support an attachment screw 79 for detachably changeably attaching a punch tip 77 to the undersurface of the punch body 41 is provided between the adjustment screw member 43 and the punch body 41.

When, as described above, the fittingly-inserted engagement portion 57 of the adjustment screw member 43 is integrally fixed to the engagement recess portion 69 of the punch body 41 by their fittingly-inserted engagement, the adjustment screw member 43 and the punch body 41 are fixed to each other with their axes coinciding with each other. Accordingly, the axis of the punch guide 17 and the axis of the punch body 41 are kept in the state of coinciding with each other.

A lubricating oil path (lubricating oil hole) 83 whose one end communicates with the lubricating oil hole 65, and whose other end is opened to the outer peripheral surface of the punch body 41, is formed in the punch body 41. Incidentally, the lubricating oil path 83 is provided in a position whose phase is different from the phases of the key grooves 61A, 61B and the phase of the key groove 23 by approximately 90 degrees. In addition, a vertically-directed lubricating oil groove 85 communicating with the lubricating oil hole 83 and a peripheral groove 87 communicating with the lubricating oil groove 85 are formed in the outer peripheral surface of the punch body 41. Accordingly, the lubrication between the inner peripheral surface of the punch guide 17 and the outer peripheral surface of the punch body 41 is achieved by lubricating oil (oil mist) supplied through the through-hole 43H in the adjustment screw member 43.

A radial (radially-directed) communication hole 89 (see FIG. 2), which communicates with the lubricating oil groove 85, is formed in the punch guide 17. In addition, a vertically-directed groove-shaped lubricating oil path 91, which is connected to the communication hole 89, is formed in the outer peripheral surface of the punch guide 17. Peripheral grooves (lubricating oil paths) 93U, 93L formed in the outer peripheral surface of the punch guide 17 communicate with the respective upper and lower end portions of the lubricating oil path 91. Incidentally, as apparent from FIG. 1, the upper peripheral groove 93U is provided above the key grooves 61A, 61B.

Thereby, the lubricating oil is supplied to the interface between the inner peripheral surface of the punch mounting hole 5 of the punch holder 3 and the outer peripheral surface of the punch guide 17. While the punch tool device 1 is put in a state of being lifted by the lifter springs 7, the upper peripheral groove 93U is situated above parts of the wall portions 95 of the respective lifter spring containing holes 9 which are closer to the punch mounting hole 5, and the upper peripheral groove 93U communicates with the lifter spring containing holes 9, as shown in FIG. 1. Furthermore, the upper peripheral groove 93U is provided at such a height position that the upper peripheral groove 93U becomes lower than the top surfaces of the respective wall portions 95, and thus becomes out of communication with the lifter spring containing holes 9 while the punch tool device 1 is pressed down by a striker (ram) ST which is vertically movably provided to the punch press. In short, the upper peripheral groove 93U is provided to be capable of coming into and out of communication with the lifter spring containing holes 9.

A downwardly-opened circular engagement recess portion 97 is formed in the undersurface of the punch body 41 in order for the punch tip 77 to be attached to the undersurface thereof. Radially-directed keys 99 whose end portions are situated near positions opposed to the outer peripheral surface of the punch body 41 are integrally attached to the ceiling of the engagement recess portion 97. Incidentally, although the two keys 99 are illustrated, a structure may be adopted in which a single continuous key is used instead of the two keys 99. Like the engagement recess portion 69 formed in the upper surface of the punch body 41, the engagement recess portion 97 is formed with a diameter larger than that of the diameter of the punch driver 31.

A disc-shaped punch tip body 103, which is included in the punch tip 77 having a punch edge section 101 in its lower end portion is detachably fittingly inserted and engages with the engagement recess portion 97. To put it more specifically, as shown in FIGS. 4(A) to 4(F), the punch tip 77 has any one of a variety of shapes, and is provided with the disc-shaped punch tip body 103. The punch edge section 101, which has one of a variety of shapes, is integrally provided to the undersurface of the punch tip body 103. In addition, a screw hole 105, into which a detachment tool (illustration is omitted), for example, is to be screwed when the punch tip 77 is removed from the engagement recess portion 97, is formed in the undersurface of the punch edge section 101. Furthermore, a radially-directed key groove 107, which is engageable with the keys 99, is formed in the top surface of the punch tip body 103, while a screw hole 103H into which to screw the attachment screw 79 is formed in the axial portion.

Moreover, a direction restricting portion 109 for always keeping the direction of the punch tip 77 toward the punch body 41 infallibly constant when the punch tip 77 is attached to and detached from the punch body 41 is provided to a part of the punch tip body 103. To put it more specifically, a recess portion 113 with which to engage the head of a fixture 111, such as a bolt, to which one of the keys 99 is attached, is formed in the punch tip body 103. Thereby, the direction of the punch tip 77 is restricted in order that the punch tip 77 should be always directed to the same direction whenever the punch tip body 103 of the punch tip 77 is engaged with the engagement recess portion 97 of the punch body 41.

Furthermore, a structure is employed in which, when the punch tip body 103 of the punch tip 77 is fittingly inserted in and engages with the engagement recess portion 97 of the punch body 41, the inner peripheral surface of the engagement recess portion 97 and the outer peripheral surface of the punch tip body 103 is in intimate contact with each other in order that the axis of the punch body 41 and the axis of the punch tip 77 can coincide with each other. As described above, when the punch tip body 103 of the punch tip 77 is fittingly inserted in and engages with the engagement recess portion 97, the revolution of the punch tip 77 about its own axis is restricted by the engagement of the keys 99, which are provided to the punch body 41, with the key groove 107 in the punch tip body 103. In this event, more minute revolution thereof is restricted by the keys 99, which engage with the vicinities of the respective two end portions of the key groove 107, than, for example, by an otherwise single key 99. This makes it possible to maintain the direction of the punch edge section 101 toward the punch body 41.

It should be noted that, because the relationship between the keys 99 and the key groove 107 is the relative one, a configuration may be adopted in which the keys 99 are provided to the punch tip 77 while the key groove 107 is provided to the punch body 41.

A plate retainer 115 corresponding to the shape of the punch edge section 101 in the punch tip 77 is provided to the plate retention holder 71. Incidentally, a description for the detailed structure of the plate retention holder 71 will be omitted because the plate retention holder 71 of this kind is the public-known one.

Once the punch head 33 is strikingly pressed by lowering the striker ST of the punch press with the punch tool device 1 mounted in the punch mounting hole 5 in the punch press (in a state shown in FIG. 1), the foregoing configuration, first of all, makes the entire punch tool device 1 descend against the biasing forces of the elastic members 15 of the lifter springs 7. Subsequently, once the plate retention 115 pressingly fixes a plate-shaped workpiece (not illustrated), which is placed on a die (not illustrated), to the die, the punch driver 31, the punch body 41, the punch tip 77 and the like are made to descend against the biasing force of the stripper spring 35. Thereby, the punching process is performed by use of the punch edge section 101 of the punch tip 77.

While the foregoing punching process is performed as described above, oil mist (lubricating oil) is jetted out of a hole H provided in the striker ST, and the oil mist is guided to the upper and lower peripheral grooves 93U, 93L in the outer peripheral surface of the punch guide 17 via a hole 33H provided in the punch head 33, the through-hole 43H provided in the adjustment screw member 43, the lubricating oil hole 65, the lubricating oil path 83, the lubricating oil groove 85, the communication hole 89 and the lubricating oil path 91. In this event, while the punch tool device 1 is in the lower place, the upper peripheral groove 93U is put in the state of being out of communication with the lifter spring containing holes 9.

Thereby, the lubrication can be carried out by supplying the oil mist to the interface between the inner peripheral surface of the punch guide 17 and the outer peripheral surface of the punch body 41, and the interface between the outer peripheral surface of the punch guide 17 and the inner peripheral surface of the punch mounting hole 5. In addition, the oil mist is supplied to the insides of the respective lifter spring containing holes 9 via the upper peripheral groove 93U, in a stage where the striker ST is ascending in contact with the punch head 33 while the lifter springs 7 are lifting the punch tool device 1, and in an initial stage where the striker ST is lowering the punch head 33 while being in contact with the punch head 33, that is, in a stage where the striker ST is in contact with the punch head 33 and where the upper peripheral groove 93U formed in the outer peripheral surface of the punch guide 17 communicates with the lifter spring containing holes 9.

This lubricates the gaps between the bolts (guide members) 11 and the respective lifter rings 13, and keeps the lifter rings 13 vertically moving smoothly. For this reason, even in the case where the punching process is repeatedly performed in workpieces at high speed, the following operation of the punch tool device will never fall behind the vertical movements of the striker in the high-speed punching process. Furthermore, the oil mist is supplied to the elastic members 15 as well.

When, as described above, the striker ST makes the punch head 33 descend, the taper portion 39T of the punch driver 31 becomes detached from the taper hole 29T of the retainer collar 27. However, when the punch head 33 returns to the original position through its ascent, the taper portion 39T and the taper hole 29T engage with each other again. Accordingly, the axis of the retainer collar 27 and the axis of the punch driver 31 are aligned with each other every time the taper portion 39T and the taper hole 29T engage with each other again.

Furthermore, the axis of the punch guide 17 and the axis of the punch body 41 are always kept in the state of accurately coinciding with each other, by the synergy among: the high-precision fittingly-inserted engagement between the high-precision fitting hole portion 47 of the punch driver 31 and the high-precision fittingly inserted portion 51 of the adjustment screw member 43; the fixing of the adjustment screw member 43 and the punch body 41 together in advance with their axes aligned with each other, which is achieved by integrally fixing the fittingly-inserted engagement portion 57 of the adjustment screw member 43 and the engagement recess portion 69 of the punch body 41 together through their engagement; and the engagement between the taper portion 39T and the taper hole 29T.

In this respect, the self-alignment function can be provided in the proximity of the upper portion of the punch body 41 by: providing the taper hole 29T to the retainer collar 27; and providing the taper portion 39T to the lower portion of the punch driver 31. This makes it possible to align the axis of the punch body 41 with the axis of the punch guide 17 effectively. In other words, the axis of the punch tip 77 can be kept in the state of accurately coinciding with the axis of the punch guide 17, and accordingly, the high-precision punching process can be achieved. Moreover, it is possible to prevent the minute inclination of the punch body 41 to the punch guide 17, and accordingly to inhibit the galling phenomenon.

When, in FIG. 1, a component force in the left-right direction acts on the punch edge section 101, the foregoing configuration makes it possible to effectively prevent the minute inclination of the punch tip 77, because the component force is received by the vicinities of both of the left and right peripheral edge portions of the punch tip body 103, in FIG. 1, as the result of the fact that the punch tip body 103 of the punch tip 77 is shaped like a disc with a diameter larger than the outer diameter of the punch driver 31. Furthermore, when, in FIG. 2, an upward force acts on the vicinities of both of the left and right end portions of the punch edge section 101, the foregoing configuration makes it possible to effectively prevent the minute inclination of the punch tip 77 because the upward force is received by the outer peripheral edge portion of the punch tip body 103 which corresponds to the vicinities of both of the left and right end portions of the punch edge section 101.

In short, the foregoing configuration makes it possible to always keep the axis of the punch body 41 and the axis of the punch tip 77 in the state of accurately coinciding with each other, and accordingly to always perform the high-precision punching process.

It should be noted that the present invention is not limited to the above-described embodiment and the present invention can be carried out in other modes by making appropriate changes to the embodiment. For example, the engagement recess portion 97 formed in the undersurface of the punch body 41 and the outer peripheral surface of the punch tip body 103 of the punch tip 77 may be formed in a taper shape which makes the engagement recess portion 97 and the punch tip body 103 engageable with and detachable from each other, for the purpose of making it possible to easily align the axis of the punch body 41 and the axis of the punch tip 77 with each other (i.e., to make the axes coincide with each other).

Figure 5:
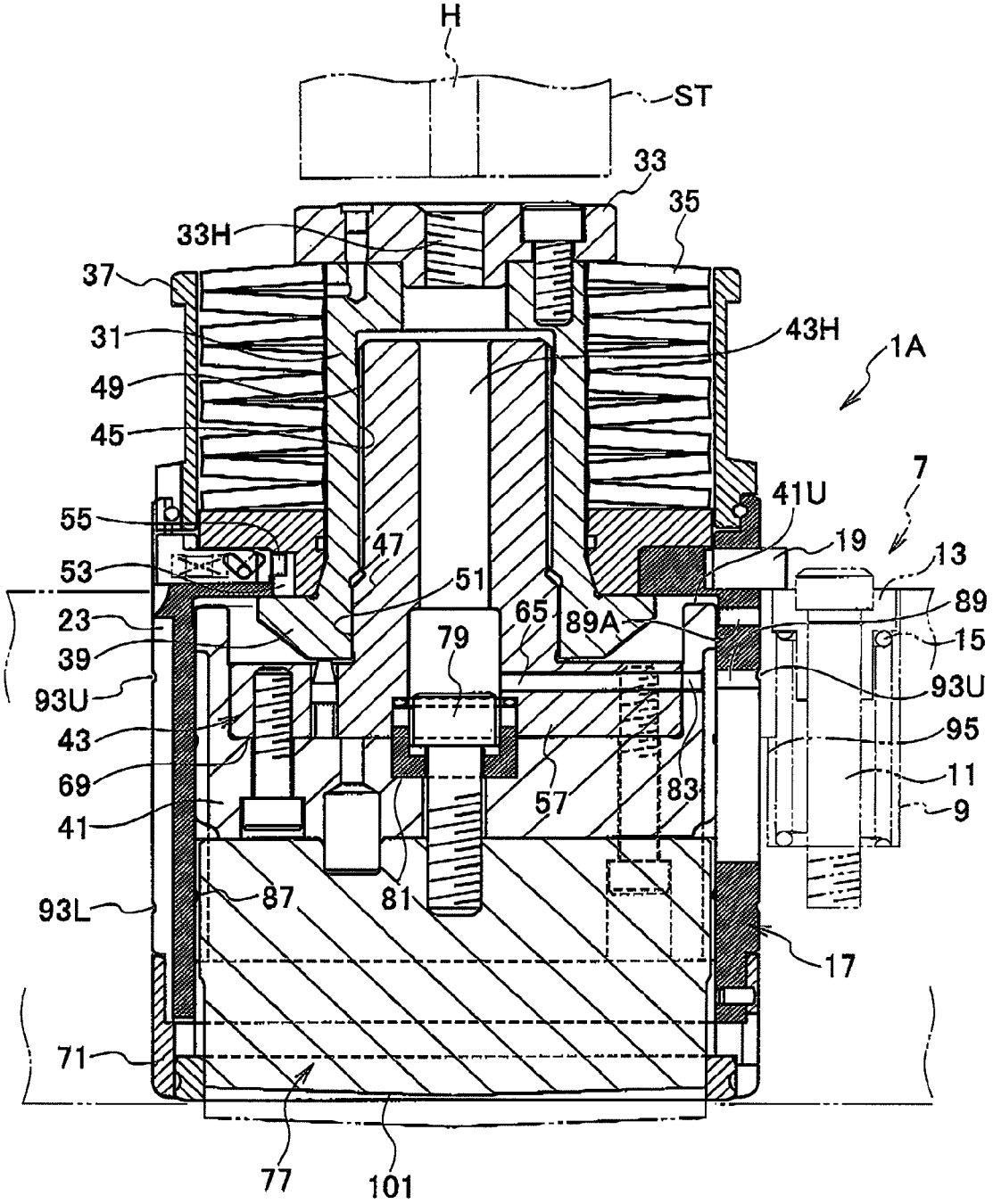
FIG. 5 is a front cross-sectional explanatory view of a punch tool device of a second embodiment of the present invention.
Figure 6:
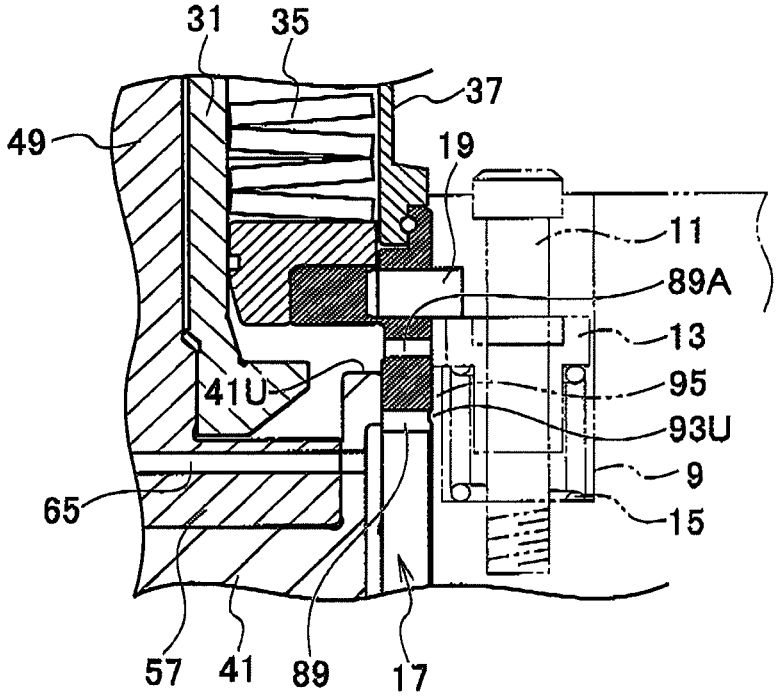
FIG. 6 is an explanatory view of a part of an emission hole of the second embodiment of the present invention.

FIG. 5 shows a second embodiment of the punch tool device. Component elements which bring about the same functions as the foregoing punch tool device 1 will be denoted by the same reference numerals, and duplicated descriptions will be omitted.

In a punch tool device 1A of the second embodiment, the lubricating oil path (lubricating oil hole) 83 formed in the punch body 41 is formed on the same line as is the lubricating oil hole 65 as the lubricating oil path formed in the fittingly-inserted engagement portion 57 in the adjustment screw member 43 horizontally in the radial direction. The communication hole 89 formed in the punch guide 17 is provided at a position which makes the communication hole 89 situated on the same line as is the lubricating oil hole 83, which is formed in the punch body 41, while the punch body 41 is lifted relative to the punch guide 17. In addition, an upper groove 93U formed in the outer peripheral surface of the punch guide 17 is formed in such a way that the upper groove 93U is connected to an opening portion of the communication hole 89.

An emission hole (discharge hole) 89A through which to emit (discharge) lubricating oil, which pools on the upper surface of the punch body 41, that is to say, on the upper surface of the fittingly-inserted engagement portion 57 integrally fittingly inserted in and engaging with the engagement recess portion 69 of the punch body 41, toward the lifter spring containing holes 9, is formed in an upper portion of the punch guide 17, which is situated above the communication hole 89. The emission hole 89A is always open, and is not closed by the vertical movement of the punch body 41 at all. In other words, regardless of vertical movements of the punch body 41 and the like, the emission hole 89A is always open for the purpose of allowing the passage of the fluid between the inside and outside of the punch guide 17 above the punch body 41.

Moreover, a relationship between the emission hole 89A and the communication hole 89 in terms of their vertical positions is the one which enables lubricating oil, which is emitted from the emission hole 89A to the outer peripheral surface of the punch guide 17, to be applied to the lower-situated communication hole 89 while going down along the outer peripheral surface thereof. In other words, it is desirable that the communication hole 89 should be provided perpendicularly below the emission hole 89A. Nevertheless, the communication hole 89 may be provided in a range slightly departing from the vertical positional relationship, as long as the lubricating oil from the emission hole 89A flows down to the range.

The foregoing configuration performs the punching process on a workpiece in the above-described manner when, as described above, the striker (ram) ST of the punch press strikingly presses the punch head 33. While the punching process is being performed on a workpiece as described, once oil mist (lubricating oil) is jetted through the hole H provided in the striker ST, the oil mist jetted through the hole H of the striker ST is directly jetted to the insides of the respective lifter spring containing holes 9, because in the initial phase where the striker ST begins to make the punch head 33 descend while being in contact with the punch head 33, the lubricating oil hole 65 provided in the adjustment screw member 43, the lubricating oil hole 83 formed in the punch body 41 and the communication hole 89 formed in the punch guide 17 are put in the state of coinciding with one another in a straight line. Thereby, the oil mist is supplied to the guide members 11, the lifter rings 13 and the elastic members 15, respectively.

In short, the punch tool device 1A of the second embodiment makes it possible to supply the oil mist to the insides of the respective lifter spring containing holes 9 more effectively.

As described, the ascent of the punch body 41 is achieved by the operation of the stripper spring 35 after the punch body 41 is made to descend in the punch guide 17 due to the strikingly pressing of the punch head 33 by the striker ST. In this respect, lubricating oil adhering to the inner peripheral surface of the punch guide 17 in the shape of a film is scraped by the punch body 41, and is pooled on the upper surface of the punch body 41. The lubricating oil thus pooled on the upper surface of the punch body 41 is jetted to the lifter spring containing holes 9 via the emission hole 89A, and lubricates the lifter rings 13 and the like, while the punch body 41 is ascending in the punch guide 17. Incidentally, lubricating oil may be beforehand pooled on the upper surface of the punch body 41 when the punch tool device 1A is assembled.

Furthermore, in the foregoing configuration, lubricating oil, which flows down along the outer peripheral surface of the punch guide 17 and enters the communication hole 89 after its emission from the emission hole 89A, is jetted at the same time as oil mist is jetted through the communication hole 89. This makes it possible to lubricate the lifter rings 13 and the like more effectively.

As already understood, while the punch body 41 is put in the state of ascending in the punch guide 17, the lubricating oil hole 65 formed in the adjustment screw member 43, the lubricating oil hole 83 formed in the punch body 41, and the communication hole 89 formed in the punch guide 17 are in the state of being aligned with one another in a straight line, as shown in FIG. 5. In other words, the lubricating hole 65, the lubricating oil hole 83 and the communication hole 89 are in the state of being arranged in a straight line. For this reason, the descent of the striker ST, which is provided to the press, is halted while the striker ST is kept in the state of being in contact with the punch head 33 without allowing the punch head 33 to descend, that is to say, when the striker ST comes into contact with the punch head 33.

Thereby, once oil mist is jetted out of the hole H in the striker ST, the oil mist is jetted to the insides of the lifter spring containing holes 9 via the communication hole 89. This makes it possible to lubricate the lifter rings 13 and the like effectively. For this reason, it is desired that, as described above, the oil mist should be jetted while the descent of the striker ST is being halted before the punching process starts to be performed on workpieces by use of the punch tool device 1A.

It should be noted that all the contents of Japanese Patent Application No. 2009-099247 (filed on Apr. 15, 2009) and all the contents of Japanese Patent Application No. 2010-002004 (filed on Jan. 17, 2010) are incorporated in the description in the application by reference.

The present invention is not limited to what has been described with regard to the embodiments of the present invention. The present invention can be carried out in other various modes by making appropriate changes to the embodiments.

The invention claimed is:

1. A method of supplying lubricating oil to a lifter spring by use of a punch tool device, the method comprising:

providing a punch tool device having a tubular punch guide vertically movably mounted in a punch mounting hole provided in a punch holder of a punch press;

providing a vertically movable punch body inside the punch guide, and including a punch edge section in a lower end portion of the punch body;

providing a punch driver above the punch body;

providing a punch head on an upper end portion of the punch driver;

providing an elastic member between the punch head and the punch guide;

supporting a supported section by a lifter spring disposed in the punch holder, and the supported section is provided on an outer peripheral surface of the punch guide;

forming a lubricating oil hole in the punch body horizontally in a radial direction, so as to open to an outer peripheral surface of the punch body;

providing a communication hole in the punch guide, the communication hole configured to come into and out of alignment with the lubricating hole;

providing an emission hole provided at an upper portion of the punch guide, the emission hole configured to emit lubricating oil to pool on an upper surface of the punch body;

allowing a striker of the punch press to descend until the striker comes into contact with the punch head of the punch tool device;

halting the descent of the striker when the striker comes into contact with the punch head;

keeping the striker in the state of being in contact with the punch head without allowing the punch head to descend further;

holding the lubricating oil hole and the communication hole provided in the punch guide in a state of being aligned with each other in a straight line;

directly supplying the lubricating oil provided from a hole in the striker to the lifter spring from the lubricating oil hole via the communication hole; and transmitting, by the emission hole, the lubricating oil to the lifter spring when the punch body ascends in the punch guide after the punch body is made to descend in the punch guide due to the striking of the punch head by the striker.

2. A method of supplying lubricating oil to a lifter spring by use of a punch tool device, the method comprising:

allowing a striker of a punch press to descend until the striker comes into contact with a punch head of the punch tool device;

halting the descent of the striker when the striker comes into contact with the punch head;

keeping the striker in contact with the punch head without allowing the punch head to descend further;

holding a lubricating oil hole and a communication hole provided in a tubular punch guide in a state of being aligned with each other in a straight line; and directly supplying lubricating oil jetted from a hole in the striker to a lifter spring from a lubricating oil path via the communication hole, wherein the punch tool device comprises:

the punch guide vertically movably mounted in a punch mounting hole;

a punch body vertically movably provided inside the punch guide, and including a punch edge section in a lower end portion of the punch body;

a punch driver provided above the punch body;

the punch head provided on an upper end portion of the punch driver;

an elastic member provided between the punch head and the punch guide;

a lifter spring containing hole that contains the lifter spring configured to lift the punch tool device, the lifter spring containing hole including a wall portion;

a supported section supported by the lifter spring, and the supported section is provided on an outer peripheral surface of the punch guide;

the lubricating oil path connected with a lubricating oil supply path in the punch body is provided in the outer peripheral surface of the punch guide; and an emission hole provided at an upper portion of the punch guide, the emission hole configured to emit lubricating oil to pool on an upper surface of the punch body, and transmit the lubricating oil to the lifter spring when the punch body ascends in the punch guide after the punch body is made to descend in the punch guide due to striking of the punch head by the striker, and the lubricating oil path is provided at a height position where the lubricating oil path communicates with the lifter spring containing hole while the lubricating oil path is situated above a part of the wall portion, the lubricating oil path becoming situated above the part of the wall portion when the punch tool device is in a state of being lifted by the lifter spring, and where the lubricating oil path comes out of communication with the lifter spring containing hole while the lubricating oil path is situated lower than a top of the wall portion, the lubricating oil path becoming situated lower than the top of the wall portion when the punch tool device is pressed down by the striker, the striker being configured to provide a vertical movement to the punch press.

3. The method of supplying lubricating oil according to claim 2, wherein the lubricating oil path is provided at a position higher than a vertically directed key groove that is provided in the punch guide and engages with a key provided to any one of the punch body and the punch driver.

4. The method of supplying lubricating oil according to claim 2, wherein the lifter spring containing hole is spaced from the punch mounting hole.

5. The method of supplying lubricating oil according to claim 2, wherein the entire lifter spring is received within the lifter spring containing hole.

6. The method of supplying lubricating oil according to claim 2, wherein the lifter spring containing hole is provided in the punch holder.

7. The method of supplying lubricating oil according to claim 2, wherein when the lubricating oil path is in alignment with the lifter spring containing hole, the lubricating oil is supplied to the lifter spring containing hole of the punch holder, and when the lubricating oil path is out of alignment with the lifter spring containing hole, the lubricating oil is supplied to portions of the punch tool device.

8. The method of supplying lubricating oil according to claim 7, wherein the lubricating oil path is facing the wall portion of the lifter spring hole when the lubricating oil path is out of alignment with the lifter spring containing hole.

9. The method of supplying lubricating oil according to claim 7, wherein the lubricating oil path is disposed higher than the wall portion of the lifter spring hole when the lubricating oil path is in alignment with the lifter spring containing hole.

10. The method of supplying lubricating oil according to claim 2, wherein the emission hole is located above the lubricating oil path.

11. The method of supplying lubricating oil according to claim 10, wherein the emission hole is always situated above the part of the wall portion when the punch tool device is lifted by the lifter spring, and when the punch tool device is pressed by the striking of the punch head by the striker.

12. The method of supplying lubricating oil according to claim 2, wherein the emission hole is always situated above the part of the wall portion when the punch tool device is lifted by the lifter spring, and when the punch tool device is pressed by the striking of the punch head by the striker.

13. A method of supplying lubricating oil to a lifter spring by use of a punch tool device, the method comprising:

allowing a striker of a punch press to descend until the striker comes into contact with a punch head of the punch tool device;

halting the descent of the striker when the striker comes into contact with the punch head;

keeping the striker in contact with the punch head without allowing the punch head to descend further;

holding a lubricating oil hole and a communication hole provided in a tubular punch guide in a state of being aligned with each other in a straight line; and directly supplying lubricating oil jetted from a hole in the striker to a lifter spring from a lubricating oil path via the communication hole, wherein the punch tool device comprises:

the punch guide vertically movably mounted in a punch mounting hole;

a punch body vertically movably provided inside the punch guide, and including a punch edge section in a lower end portion of the punch body;

a punch driver provided above the punch body;

the punch head provided on an upper end portion of the punch driver;

an elastic member provided between the punch head and the punch guide;

a supported section supported by the lifter spring disposed in the punch holder, and the supported section is provided on an outer peripheral surface of the punch guide;

the lubricating oil hole is provided in the punch body, and extends horizontally in a radial direction so as to open to an outer peripheral surface of the punch body; and an emission hole for emitting lubricating oil to the lifter spring together with compressed air, the lubricating oil emitted to pool on an upper surface of the punch body, the emission hole transmits the lubricating oil to the lifter spring when the punch body ascends in the punch guide after the punch body is made to descend in the punch guide due to the striking of the punch head by the striker, and the emission hole is provided at an upper portion of the punch guide, and the compressed air is produced when air located in a space surrounded by an inner peripheral surface of the punch guide is compressed while the punch body is ascending in the punch guide after the punch body is made to descend in the punch guide due to striking of the punch head by a striker.

14. The method of supplying lubricating oil according to claim 13, wherein the emission hole is provided on the punch guide and the lubricating oil emitted from the emission hole flows down along a surface of the punch guide.

15. The method of supplying lubricating oil according to claim 14, wherein the emission hole is always open to the lifter spring regardless of vertical movements of the punch guide.

16. The method of supplying lubricating oil according to claim 13, wherein the lifter spring containing hole is spaced from the punch mounting hole.

17. The method of supplying lubricating oil according to claim 13, wherein the entire lifter spring is received within the lifter spring containing hole.

* * * * *